US007255076B2

(12) United States Patent
Han

(10) Patent No.: US 7,255,076 B2
(45) Date of Patent: Aug. 14, 2007

(54) VARIABLE VALVE LIFT APPARATUS FOR VEHICLE ENGINES

(75) Inventor: Dong-Hee Han, Seoul (KR)

(73) Assignee: Hyundai Motor Company, Seocho-Ku, Seoul (KR)

( * ) Notice: Subject to any disclaimer, the term of this patent is extended or adjusted under 35 U.S.C. 154(b) by 0 days.

(21) Appl. No.: 11/299,381

(22) Filed: Dec. 8, 2005

(65) Prior Publication Data

US 2007/0107682 A1 May 17, 2007

(30) Foreign Application Priority Data

Nov. 16, 2005 (KR) ..... 10-2005-0109574

(51) Int. Cl.
*F01L 1/34* (2006.01)

(52) U.S. Cl. ..... 123/90.16; 123/90.2; 123/90.15; 123/90.17; 123/90.31; 74/568 R; 74/569

(58) Field of Classification Search ..... 123/90.16
See application file for complete search history.

(56) References Cited

U.S. PATENT DOCUMENTS 6,752,107 B2 * 6/2004 Kreuter ..... 123/90.16

FOREIGN PATENT DOCUMENTS

| | | |
|---|---|---|
| JP | 05-044418 | 2/1993 |
| JP | 06-101436 | 4/1994 |
| JP | 11-036833 | 2/1999 |
| JP | 11-229834 | 8/1999 |
| JP | 2001-020711 | 1/2001 |

* cited by examiner

*Primary Examiner*—Thomas Denion
*Assistant Examiner*—Kyle M. Riddle
(74) *Attorney, Agent, or Firm*—Morgan Lewis & Bockius LLP

(57) ABSTRACT

The present invention provides a variable valve lift apparatus for vehicle engines. A low-speed arm is installed in a high-speed arm to overlap the high-speed arm. A compression pin, a center pin, and a return spring are installed in a roller shaft of the low-speed arm and both cylinders of the high-speed arm. Further, an oil passage extends through a rocker arm shaft boss and a side body of the high-speed arm to the cylinder having the compression pin. Such a construction reduces the overall width of the apparatus, allows respective valves to be independently controlled, reduces design limitations due to the interference with a cam journal, and easily ensures an oil path. Further, a latching pin (the compression pin and the center pin) is supported at two places, thus enhancing the reliability and stability of a latching operation.

3 Claims, 3 Drawing Sheets

VARIABLE VALVE LIFT APPARATUS FOR VEHICLE ENGINES

CROSS-REFERENCE TO RELATED APPLICATIONS

The present application is based on, and claims priority from, Korean Application Serial Number 10-2005-0109574, filed on Nov. 16, 2005, the disclosure of which is hereby incorporated by reference herein in its entirety.

FIELD OF THE INVENTION

The present invention relates to a variable valve lift apparatus for a vehicle engine, which adjusts the valve stroke of the engine according to the load condition of the engine, thus maintaining the optimum intake/exhaust state, therefore improving the performance of the engine.

BACKGROUND OF THE INVENTION

An engine produces a high output, when the inflow of external air into a combustion chamber and the discharge of combustion gas from the combustion chamber are completely and rapidly executed.

However, if the operation of an intake/exhaust valve has a fixed pattern, it is impossible to optimally control the suction of external air and the discharge of combustion gas, according to the engine load.

Thus, recently, the use of a variable valve lift (VVL) has been gradually popularized.

Currently, rocker arm-type apparatuses, which are representative variable valve lift apparatuses, have been proposed. The rocker arm-type apparatuses include one produced by Honda and one produced by Toyota. The Honda's apparatus is constructed so that a rocker arm for a high-speed cam is mounted between two rocker arms, and the connection to the high-speed cam is controlled via a pin, thus converting a lift. The Toyota's apparatus is constructed so that a pin is inserted into a follower of a high-speed cam, which reciprocates while slidably contacting the high-speed cam.

However, since both of the apparatuses are simultaneously connected to two valves (pair of intake valves, pair of exhaust valves), it is impossible to individually control each of the valves. To this end, an additional device is required. Further, the conventional apparatuses are problematic in that they limit the design of a head, due to the interference with a cam journal or the like.

In addition to the above-mentioned type of apparatus, swing arm-type apparatuses which independently control respective valves have been used. However, the swing arm-type apparatus has a problem in that it is difficult to supply hydraulic pressure to a latching system, so that latching reliability is poor. The swing arm-type apparatus has another problem in that it is difficult to ensure sufficient strength, in comparison with the rocker arm-type apparatus.

SUMMARY OF THE INVENTION

Embodiments of the present invention provide a variable valve lift apparatus for a vehicle engine, which is capable of independently controlling respective valves, unlike the conventional rocker arm-type valve lift apparatus, thus reducing the restriction on the position of a cam journal of a head, and which is capable of more easily ensuring an oil path, compared to the conventional swing arm-type valve lift apparatus, thus enhancing latching reliability.

A variable valve lift apparatus for vehicle engines according to an embodiment of the present invention includes a high-speed arm having a body which includes a bottom plate and vertical plates and is rotatably mounted to a rocker arm shaft. Cam contact parts are provided on upper ends of respective vertical plates, and contact high-speed cams. First and second cylinders are provided under the corresponding cam contact parts. A side body couples the first cylinder to a rocker arm shaft boss provided on an associated vertical plate. Further, an oil hole, an annular groove, and an oil passage are provided in the rocker arm shaft, the rocker arm shaft boss, and the side body, respectively, and make an interior of the rocker arm shaft communicate with the first cylinder. The variable valve lift apparatus also includes a low-speed arm, a compression pin, a center pin, and a return spring. The low-speed arm is located between the vertical plates of the high-speed arm, and is rotatably mounted to the rocker arm shaft. The low-speed arm includes a roller shaft having the same inner diameter as each of the first and second cylinders of the high-speed arm, a roller fitted over the roller shaft and contacting a low-speed cam, and a valve pressing end provided in front of the roller. The compression pin is provided in the first cylinder coupled to the oil passage of the high-speed arm. The center pin is provided in the roller shaft of the low-speed arm. The return spring is provided in the second cylinder of the high-speed arm.

Further, the return spring is provided with a spring cap. The spring cap has the same outer diameter as the center pin, contacts an end of the center pin, and is inserted into the second cylinder having the return spring therein in such a way as to slide along the second cylinder.

Further, opposing spring support plates are provided on ends of the high-speed arm and the low-speed arm where the rocker arm shaft passes through, with a lost motion spring being installed between the spring support plates.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Hereinafter, the present invention will be described with reference to the accompanying drawings.

Figure 1:
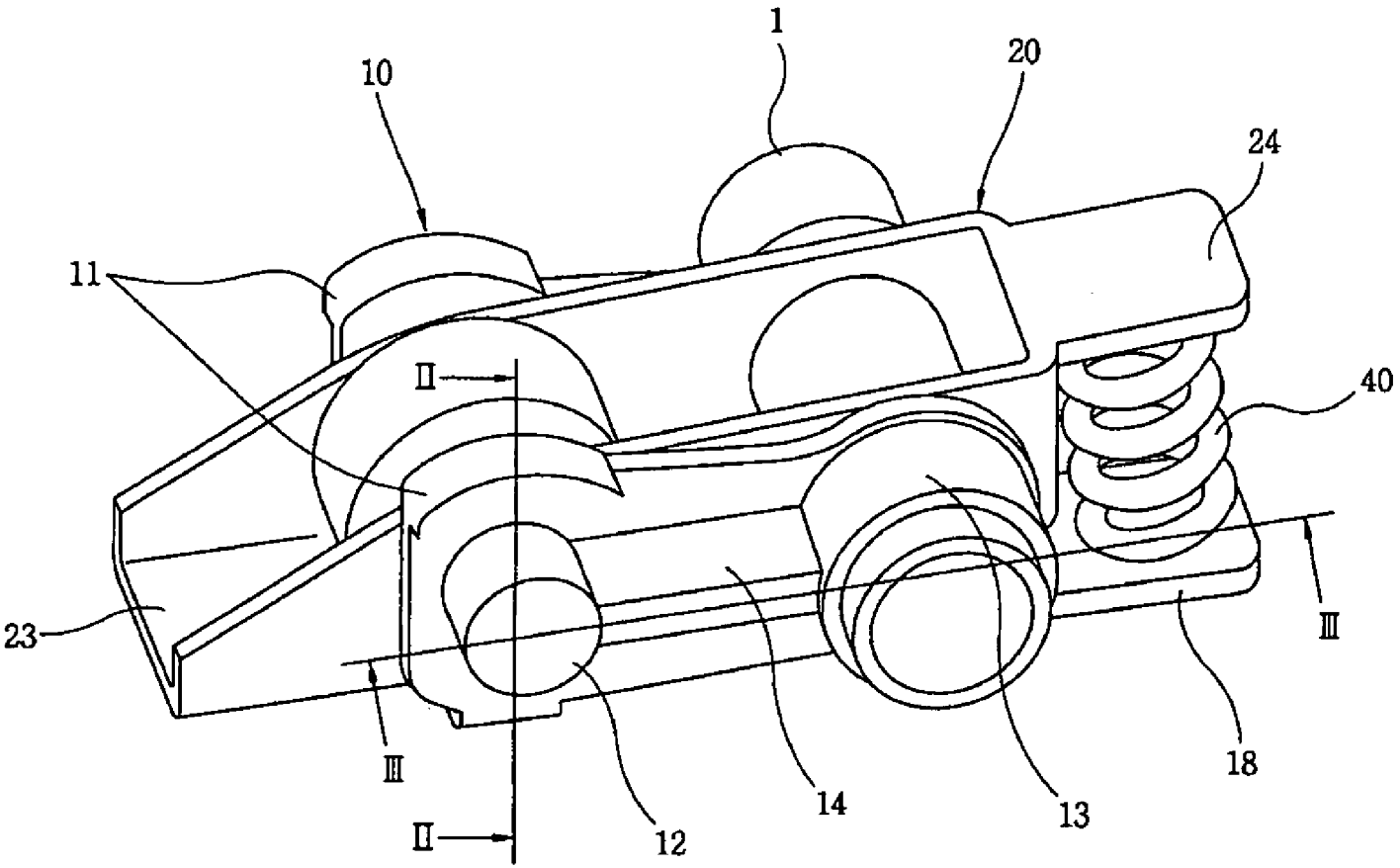
FIG. 1 is a perspective view of a variable valve lift apparatus for vehicle engines, according to the present invention.
Figure 2:
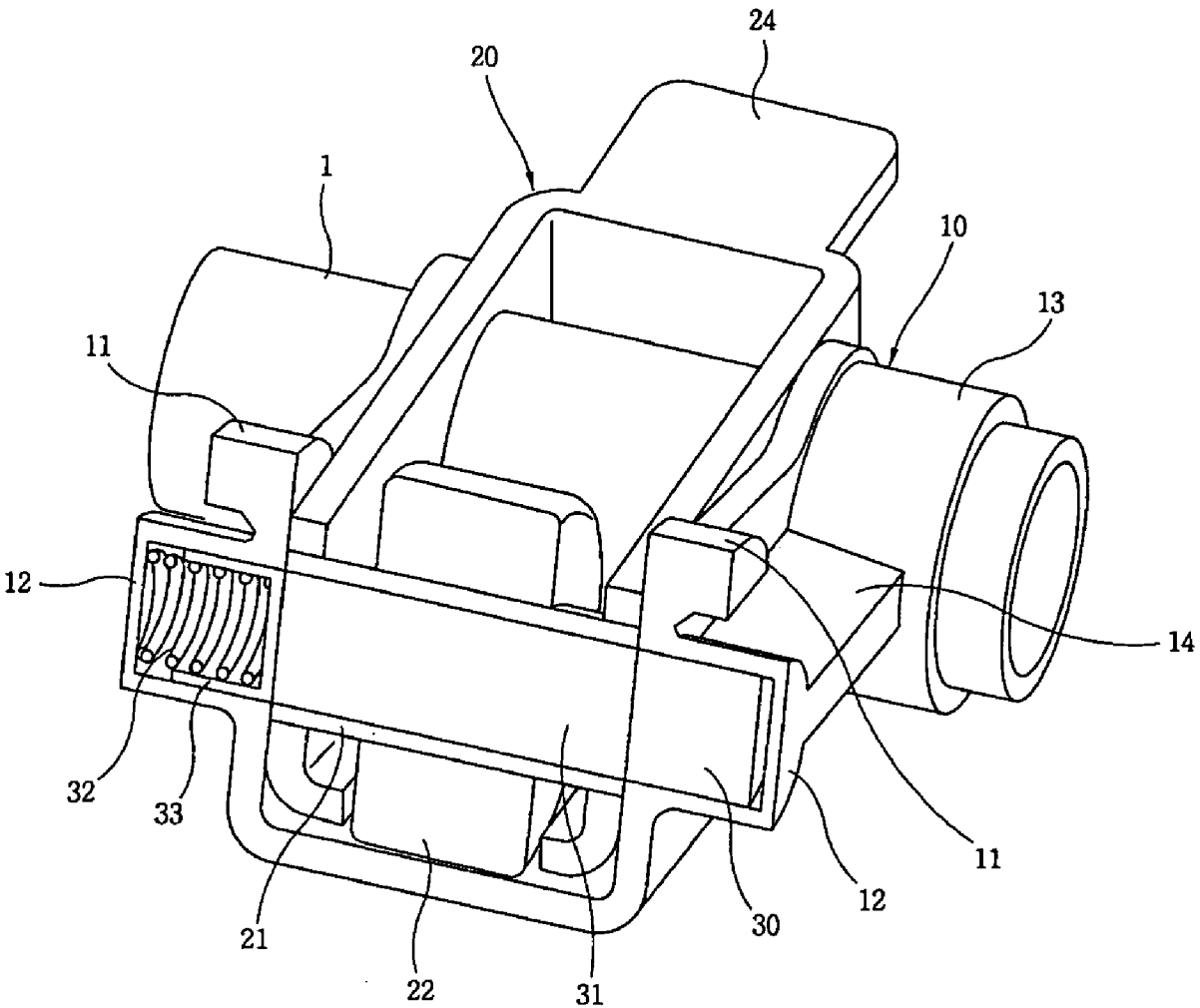
FIG. 2 is a perspective view taken along line II—II of FIG. 1.
Figure 3:
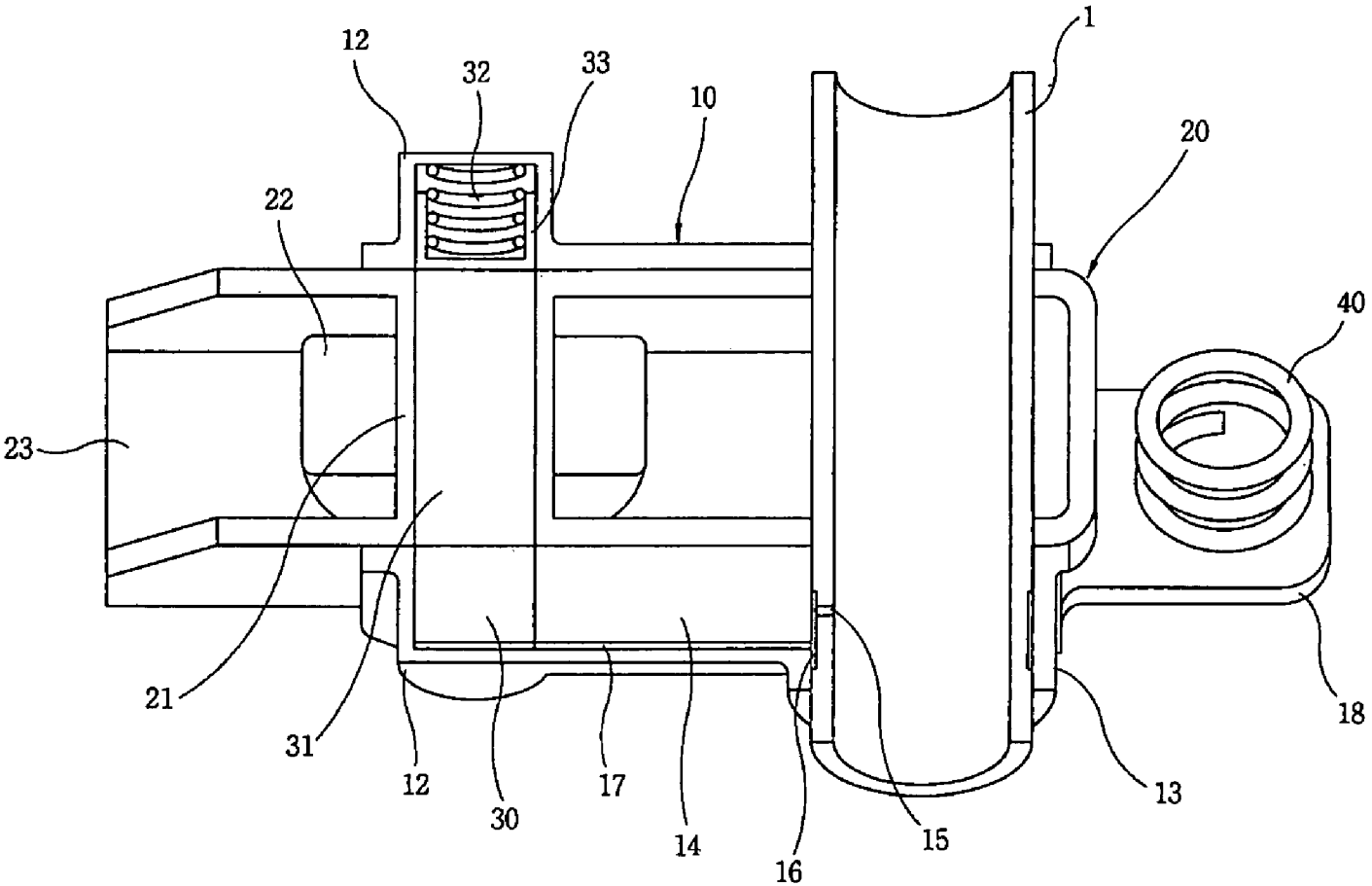
FIG. 3 is a perspective view taken along line III—III of FIG. 1.

FIG. 1 is a perspective view of a variable valve lift apparatus for vehicle engines, according to the present invention, FIG. 2 is a perspective view taken along line II—II of FIG. 1, and FIG. 3 is a perspective view taken along line III—III of FIG. 1. The present invention will be described with reference to FIGS. 1 through 3.

The variable valve lift apparatus of the present invention includes a high-speed arm 10 operated in conjunction with high-speed cams, a low-speed arm 20 operated in conjunction with a low-speed cam, and a latching pin which connects or disconnects the components to or from each other.

The high-speed arm 10 includes a bottom plate and both vertical plates, thus having a body having a "U"-shaped cross-section.

Cam contact parts 11 each having a gently curved surface are provided on upper ends of the vertical plates of the high-speed arm 10, so that the high-speed cams are in the contact with the cam contact parts 11.

Further, opposing cylinders 12 are provided at positions under the cam contact parts 11 in such a way as to protrude from the vertical plates. The cylinders 12 have the same inner diameter.

A rocker arm shaft 1 passes through an end of the valve lift apparatus, which is opposite the end having the cylinders 12. A rocker arm shaft boss 13 is provided on one of the vertical plates, and a side body 14 protrudes from the vertical plate having the rocker arm shaft boss 13 and is coupled to the rocker arm shaft boss 13. The cylinder 12 provided on the vertical late having the rocker arm shaft boss 13 is integrally coupled to the rocker arm shaft boss 13 via the side body 14.

Further, as shown in FIG. 3, the rocker arm shaft 1 is a hollow shaft which allows operating oil to flow therein. An oil hole 15 is formed at a predetermined position in the rocker arm shaft 1. An annular groove 16 is formed on the inner circumferential surface of the rocker arm shaft boss 13, which contacts the oil hole 15 (The annular groove 16 may be formed on the outer circumferential surface of the rocker arm shaft 1). Further, an oil passage 17 is defined in the side body 14 in such a way as to connect the annular groove 16 to the associated cylinder 12.

The oil passage 17 is provided on the outermost portion of the interior of the cylinder 12.

Meanwhile, the body of the low-speed arm 20 has the same cross-section of the body of the high-speed arm 10. That is, the low-speed arm 20 has a bottom plate and vertical plates.

Thus, the low-speed arm 20 is installed in the body of the high-speed arm 10 such that the vertical plates of the low-speed arm 20 contact the vertical plates of the high-speed arm 10. Of course, the rocker arm shaft 1 passes through one end of the low-speed arm 20, and is rotatably affixed to the low-speed arm 20.

A hollow roller shaft 21 having the same inner diameter as each cylinder 12 is installed to the vertical plates of the low-speed arm 20 in such a way as to be arranged between the cylinders 12 of the high-speed arm 10. A roller 22 is fitted over the roller shaft 21, and contacts the low-speed cam to operate the low-speed arm 20. The roller 22 protrudes downwards through a hole which is formed in the bottom plate of the low-speed arm 20, and contacts the bottom plate of the high-speed arm 10 when the low-speed arm 20 rotates.

Of course, the roller 22 may be formed to be small such that it occupies only the space above the bottom plate of the low-speed arm 20.

Further, one end of the low-speed arm 20, which is opposite the end through which the rocker arm shaft 1 passes, protrudes out of the body of the high-speed arm 10, thus forming a valve pressing end 23 that presses the upper end of a valve (not shown).

Meanwhile, the latching pin includes a compression pin 30 and a center pin 31. The compression pin 30 is installed in the cylinder 12 which is provided to one side of the high-speed arm 10. The center pin 31 is installed in the roller shaft 21 of the low-speed arm 20. In this case, the compression pin 30 always contacts the center pin 31.

The length of the compression pin 30 is determined so that the compression pin 30 does not hide the oil passage 17, when one end surface of the compression pin 30 is placed on the same plane as the inner surface of the vertical plate of the high-speed arm 10.

The length of the center pin 31 is determined so that the center pin 31 is positioned only in the roller shaft 21 of the low-speed arm 20, when hydraulic pressure is not transmitted. That is, when the center pin 31 is positioned at the center, opposite ends of the center pin 21 do not protrude out of the outer surfaces of the vertical plates of the low-speed arm 20, and do not enter space in the cylinders 12.

A return spring 32 is provided in the cylinder 12 which is opposite the cylinder 12 having the compression pin 30 therein. Thus, after an operation is executed by hydraulic pressure (the left direction in FIG. 2), the return spring 32 serves to return the center pin 31 to an original position thereof.

A spring cap 33 is provided on the return spring 32 to cover one end of the return spring 32. The spring cap 33 has the shape of a cylinder which has the same outer diameter (the diameter corresponding to the inner diameter of each cylinder 12) as the center pin 31. The spring cap 33 is inserted into the cylinder 12, and is slidably moved. When the return spring 32 is not compressed, one end surface of the spring cap 33 contacting the center pin 31 is located in the same plane as the inner surface of an associated vertical plate. That is, the spring cap 33 does not move beyond the cylinder 12.

Further, spring support plates 18 and 24 each having the shape of a simple flat plate are provided on the rear ends of the high-speed arm 10 and the low-speed arm 20, that is, an end adjacent to a portion where the rocker arm shaft 1 passes through.

The spring support plates 18 and 24 are provided to face each other. A lost motion spring 40, which is a coil spring, is provided between the spring support plates 18 and 24.

The operation of the variable valve lift apparatus according to the invention will be described below.

In order to operate the valve lift apparatus of this invention, the low-speed cam having the profile of a short semi-major axis is attached to a cam shaft in such a way as to be positioned above the roller 22. The high-speed cams, having the profile of a longer semi-major axis than the low-speed cam, are provided adjacent to both sides of the low-speed cam.

In the low-speed part load operation of the engine, hydraulic pressure is not generated in the rocker arm shaft 1.

Thus, the compression pin 30 and the center pin 31 are located only in the cylinder 12 and the roller shaft 21, respectively. Thereby, the high-speed arm 10 and the low-speed arm 20 are independently operated while being separated from each other.

Thus, the operation of the high-speed arm 10 by the high-speed cams does not affect the low-speed arm 20. The low-speed arm 20 is rotated about the rocker arm shaft 1 only by the profile of the low-speed cam which presses the roller 22.

In a detailed description, when the low-speed cam 20 is pressed down by the low-speed cam, the valve pressing end 23 of the low-speed arm 20 presses the valve contacting the valve pressing end 23. Thereby, the valve is opened or closed, depending on the profile of the low-speed cam. The low-speed arm 20 returns to its original position and the contact of the roller 22 with the low-speed cam is maintained by a return spring installed in a valve stem.

At this time, the high-speed arm 10 to which the rotation of the high-speed cams is transmitted through the cam contact parts 11 receives lost motion that does not affect the opening or closing of the valve. After receiving the lost motion from the high-speed cams, the high-speed arm is returned to its original position by the restoring force of the lost-motion spring 40, and constantly contacts the high-speed cams.

Meanwhile, in the high-speed full load operation of the engine, the hydraulic pressure transmitted into the rocker arm shaft 1 is sequentially transmitted through the oil hole 15, the annular groove 16, and the oil passage 17, prior to being transmitted to the cylinder 12. Thereby, the compression pin 30 moves forwards, and thus pushes the center pin 31.

Thus, the compression pin 30 and the center pin 31 are held by the vertical plates of both the high-speed arm 10 and low-speed arm 20, so that the high-speed arm 10 and the low-speed arm 20 are integrally linked together.

When the high-speed arm 10 is operated by the high-speed cams contacting the cam contact parts 11, the low-speed arm 20 is moved, like the high-speed arm 10. Consequently, the valve pressed by the valve pressing end 23 is opened or closed, depending on the profile of the high-speed cams. The low-speed cam having a profile shorter than the high-speed cams does not affect the opening or closing of the valve.

Thereafter, when the engine is converted into a low-speed part load operation state, pressure acting in the cylinder 12 connected to the rocker arm shaft 1 disappears, so that the center pin 31 and the compression pin 30 are returned to their original positions by the restoring force of the return spring 32. Thereby, the coupling of the high-speed arm 10 to the low-speed arm 20 is released, so that the valve is opened or closed according to the profile of the low-speed cam.

Meanwhile, the spring cap 33 provided on the return spring 32 slides along the inner circumferential surface of the cylinder 12. Thus, during operation, the spring cap 33 functions to stably maintain the installed state of the return spring 32 in the cylinder 12, and to stably transmit force acting between the return spring 32 and the center pin 31.

In the variable valve lift apparatus constructed as described above, the low-speed arm 20 is installed in the high-speed arm 10 in such a way that the body of the low-speed arm 20 overlaps the body of the high-speed arm 10. Thus, the width of the variable valve lift apparatus is considerably reduced, in comparison with the conventional variable valve lift apparatus.

Therefore, an integral valve lift apparatus is not installed for one pair of valves (pair of intake valves or pair of exhaust valves) of a four valve system, but it is possible to install a valve lift apparatus for each valve. Hence, each valve may be independently controlled.

As such, each valve is independently controlled, so that an additional independent control device is not required, unlike the conventional rocker arm-type variable valve lift apparatus. Thus, the overall construction of this invention is simplified, thus reducing interference with a cam journal or the like.

Meanwhile, a simpler and more stable oil path is ensured, compared to the conventional swing arm-type variable valve lift apparatus, so that the latching operation of the latching pin is precisely executed according to the engine load.

Further, both the compression pin and the center pin function to couple the high-speed arm to the low-speed arm, thus a more stable latching state can be maintained.

As apparent from the foregoing, there is an advantage in the present invention in that each valve can be independently controlled, unlike the conventional rocker arm-type valve lift apparatus, so that a limitation in the position of a cam journal of a head is reduced, and an oil path is more easily ensured, in comparison with the conventional swing arm-type valve lift apparatus, so that latching reliability is enhanced, and a latching pin is supported at two places, so that latching stability is enhanced.

What is claimed is:

1. A variable valve lift apparatus for vehicle engines, comprising:

a high-speed arm, comprising:

a body including a bottom plate and vertical plates, and rotatably mounted to a rocker arm shaft;

cam contact parts provided on upper ends of respective vertical plates, and contacting high-speed cams;

first and second cylinders provided under the corresponding cam contact parts;

a side body to couple the first cylinder to a rocker arm shaft boss provided on an associated vertical plate; and an oil hole, an annular groove, and an oil passage provided in the rocker arm shaft, the rocker arm shaft boss, and the side body, respectively, and making an interior of the rocker arm shaft communicate with the first cylinder;

a low-speed arm located between the vertical plates of the high-speed arm, and rotatably mounted to the rocker arm shaft, and comprising:

a roller shaft having the same inner diameter as each of the first and second cylinders of the high-speed arm;

a roller fitted over the roller shaft, and contacting a low-speed cam; and a valve pressing end provided in front of the roller;

a compression pin provided in the first cylinder coupled to the oil passage of the high-speed arm;

a center pin provided in the roller shaft of the low-speed arm; and a return spring provided in the second cylinder of the high-speed arm.

2. The variable valve lift apparatus as defined in claim 1, wherein said return spring is provided with a spring cap, the spring cap having the same outer diameter as the center pin, contacting an end of the center pin, and being inserted into the second cylinder having the return spring therein in such a way as to slide along the second cylinder.

3. The variable valve lift apparatus as defined in claim 1, wherein opposing spring support plates are provided on ends of the high-speed arm and the low-speed arm where the rocker arm shaft passes through, with a lost motion spring being installed between the spring support plates.

* * * * *